United States Patent [19]

Popp et al.

[11] Patent Number: 4,594,214

[45] Date of Patent: Jun. 10, 1986

[54] CONTAINER FOR STORING RADIOACTIVE MATERIALS

[75] Inventors: Franz-Wolfgang Popp, Wedemark; Reinhold Velten, Solms, both of Fed. Rep. of Germany

[73] Assignee: Deutsche Gesellschaft für Wiederaufarbeitung von Kernbrennstoffen mbH, Hanover, Fed. Rep. of Germany

[21] Appl. No.: 626,714

[22] Filed: Jul. 2, 1984

[30] Foreign Application Priority Data

Jul. 12, 1983 [DE] Fed. Rep. of Germany ..... 3325119

[51] Int. Cl.[4] ..... G21C 19/00

[52] U.S. Cl. ..... 376/272; 220/256; 250/506.1

[58] Field of Search ..... 250/506.1, 507.1, 517.1; 376/272; 294/67 D, 67 DA, 86 A, 93; 220/256, 319

[56] References Cited

U.S. PATENT DOCUMENTS

| | | | |
|---|---|---|---|
| 157,165 | 11/1874 | Ellsworth | 294/93 |
| 1,359,649 | 11/1920 | Allison | 294/93 |
| 1,576,535 | 3/1926 | Muir | 250/506.1 |
| 2,269,026 | 1/1942 | Klinghoffer | 250/507.1 |
| 2,507,675 | 5/1950 | Morris | 294/93 |
| 2,682,352 | 6/1954 | Hawkins et al. | 376/272 |
| 3,443,735 | 5/1969 | Meijers | 220/319 |
| 4,336,460 | 6/1982 | Best et al. | 250/506.1 |
| 4,445,042 | 4/1984 | Baatz et al. | 250/506.1 |

FOREIGN PATENT DOCUMENTS

| | | | |
|---|---|---|---|
| 3031211 | 3/1982 | Fed. Rep. of Germany | 250/506.1 |
| 3150663 | 6/1983 | Fed. Rep. of Germany | 376/272 |
| 1278475 | 10/1961 | France | 250/506.1 |
| 1484669 | 6/1967 | France | 250/506.1 |
| 1148816 | 4/1969 | United Kingdom | 376/272 |

*Primary Examiner*—Deborah L. Kyle
*Assistant Examiner*—Richard W. Wendtland
*Attorney, Agent, or Firm*—Walter Ottesen

[57] ABSTRACT

The invention is directed to a container for storing radioactive materials which includes a closing cover tightly secured to the outer layer of the container vessel by a continuous weld seam. The container includes an annular body which is attached to the outer layer of the vessel. The annular body has an inwardly directed flange overlapping the weld seam for protecting the latter against external blows which could occur, for example, during transport of the container. The container also includes two narrow slots formed in the annular body with U-shaped guides disposed therebeneath for receiving transport elements in engagement therewith. The annular ring therefore also serves as a transport ring for facilitating transport of the container. Since the container is held at the ring, tension forces are directed to the outer layer of the vessel and away from the weld seam.

10 Claims, 1 Drawing Figure

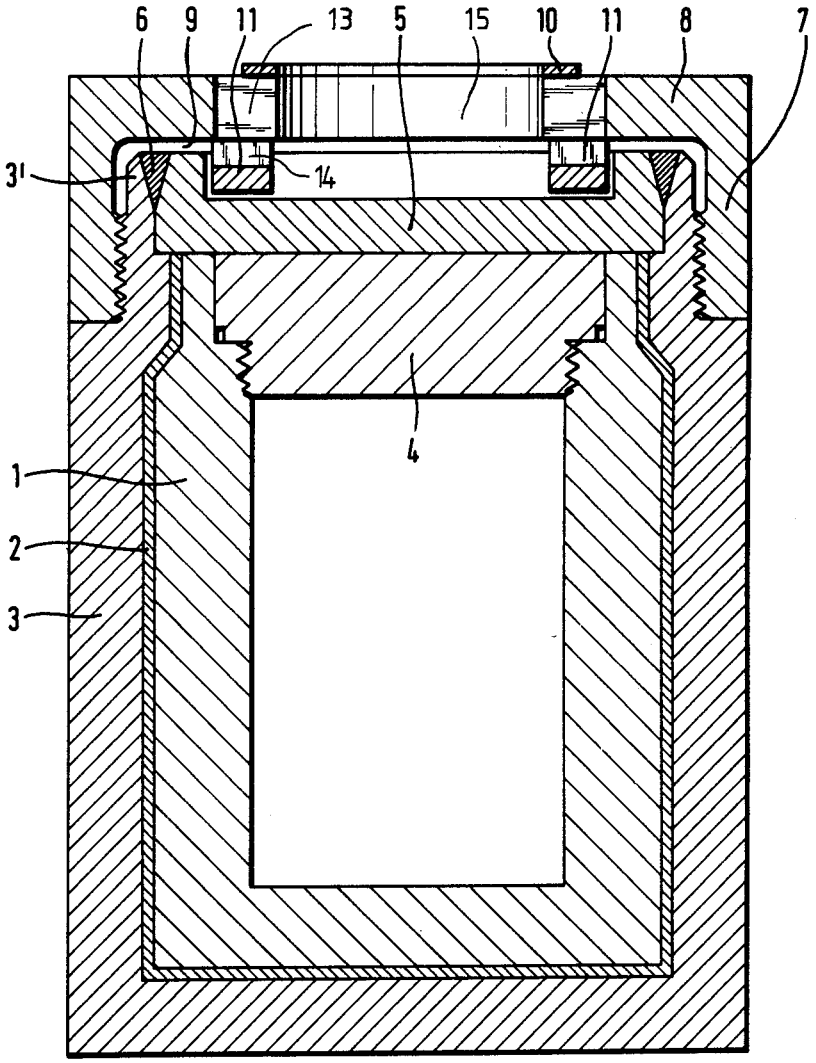
6
9
11
13
5
15
10
11
8
7
3'
14
4
1
2
3

CONTAINER FOR STORING RADIOACTIVE MATERIALS

FIELD OF THE INVENTION

The invention relates to a container for storing radioactive materials and especially for the long-term storage of irradiated nuclear reactor fuel elements. The container has an opening at one end for receiving the materials to be stored therein which is closed in a seal-tight manner with a closing cover.

BACKGROUND OF THE INVENTION

Containers of this kind have to be mechanically stable, resistant to corrosion and tightly closed. These containers include a vessel and a closing cover. The tight closure is obtained with the closing cover which is fitted into the opening and welded to the vessel wall. This seal is in the form of a continuous welding seam extending about the periphery of the cover and must define a seal-tight closure with respect to the atmosphere over a practically unlimited time. Accordingly, the highest requirements are placed upon this seal. In this connection, it is not only the quality of the weld which is of concern, but, also the resistance of the weld to unintended external forces acting thereupon.

The seal or more specifically, the continuous weld seam between the sealing cover and the wall of the vessel should be made safe against mechanical damage.

SUMMARY OF THE INVENTION

The container of the invention is intended for storing radioactive material and especially for the long-term storage of irradiated nuclear reactor fuel elements.

The container includes a vessel having a base and a wall extending upwardly from the base. The wall terminates in an upper end portion which defines the opening of the vessel through which the radioactive material to be stored therein is passed. A closing cover closes off the opening and the vessel with respect to the ambient. Sealing means preferably in the form of a weld seam is disposed along the outer periphery of the cover and seals the cover with respect to the vessel. An annular body is mounted on the outer surface of the vessel and projects upwardly beyond the weld seam and then projects inwardly to define flange means overlapping the weld seam for absorbing inadvertent external blows acting upon the container thereby protecting the weld seam therefrom.

Thus, the annular body is attached only to the outer layer of the vessel. It overlaps the weld seam and ensures that the latter will be protected against external blows which can, for example, occur during transport of the container.

In order to in every instance prevent a transmission of the blows to the weld seam in the event that the container tips over or even falls, it is preferable that the annular body be secured to the outer layer of the vessel only at an elevation beneath the weld seam and also to overlap the end portion of the vessel, the weld seam and a portion of the cover all in spaced relationship thereto. Intense blows which can act especially against the edges of the container will thereby be absorbed from a somewhat deformable annular body and be transmitted directly to the outer layer of the container. The above-mentioned spaced relationship ensures that the weld seam will be shielded against external blows without any actual contact therewith.

The action of the annular body as a shock absorber can be still further improved by providing projection means or a continuous elevated portion on the top side thereof. External blows which may occur would then be transmitted from this projection means via the somewhat deformable region of the annular body to the outer layer of the vessel.

According to a preferred embodiment of the annular body, the latter can be configured so that it can be utilized as a transport ring. For this purpose and according to a further feature of the invention, guide means are formed in the annular body for receiving transport elements in latching engagement therewith. In this way, not only external blows are absorbed by the annular body; rather, also tension forces which occur during the transport of the container are kept away from the weld seam.

BRIEF DESCRIPTION OF THE DRAWING

The invention will now be described with reference to the drawing which shows an elevation view, partially in section, of a container according to the invention.

DESCRIPTION OF THE PREFERRED EMBODIMENTS OF THE INVENTION

The container is made up of a thick-wall vessel 1 which is embedded in an outer layer 3 made of suitable high value castable material with an intermediate layer 2 disposed therebetween. The cover 4 of the vessel 1 is covered over by a further closing cover 5. The closing cover 5 is absolutely tightly joined with the outer layer 3 by means of a continuous weld seam 6 disposed about the outer periphery of the cover.

An annular body 7 is secured to the outer layer 3 and has a flange 8 directed inwardly. The annular or ring-shaped body 7 is attached to the outer layer 3 by attaching means in the form of a threaded joint 12. The annular body 7 and its flange 8 overlap the upper end portion 3' of the outer layer 3, the weld seam 6 as well as a portion of the closing cover 5 with a spacing 9. In this way, the action of the annular body 7 as a shock absorber is obtained which is further intensified by means of the projection 10 arranged on the flange 8 thereof. The projection 10 is shown in the form of a flat ring which can be held to the flange 8 by threaded bolts to facilitate easy removal and reattachment thereof. When in place, the ring 10 covers two diametrically opposed slots 13 formed in the flange 8.

Two U-shaped guides 11 are welded to the lower side 14 of the flange 8 of the annular body 7. The two U-shaped guides 11 straddle respective ones of the slots 13 and serve to receive transport hooks of a transport machine therein. The distance between the legs of the U-shaped guides 11 can be, for example, twice the width of the narrow slots 13.

When the container is to be transported, the flat ring 10 is removed and transport hooks are lowered through circular opening 15 in the flange 8. The transport hooks can be L-shaped, for example, and have a narrow shank which fits into the slot 13 which imparts lateral support thereto during a lifting operation. The lower portion of the hook is wider than its shank and holds the container at the lower surface 14 of the flange 8. After the container has been placed at its new location, the transport hooks are removed and the flat ring 10 is again bolted into place. Accordingly, the annular body 7 serves the duel function of a protective ring and a transport ring.

In the illustrated embodiment, an annular body was shown only at one end face of the container. It is understood that it is possible to provide annular bodies at both end faces of the container, respectively, in order to make use of the absorbing action provided thereby at both ends of the container.

It is further understood that the foregoing description is that of the preferred embodiments of the invention and that various changes and modifications may be made thereto without departing from the spirit and scope of the invention as defined in the appended claims.

What is claimed is:

1. A container for storing radioactive material, the container comprising:

a vessel having a base and a wall extending upwardly from said base, said wall terminating in an upper end portion defining the opening of the vessel through which the radioactive material to be stored therein is passed;

a closing cover mounted on said upper end portion for closing off said opening;

sealing means disposed at the outer periphery of said cover for sealing the same with respect to said upper end portion of said vessel;

an annular body attached to said vessel at a location beneath said upper end portion and projecting upwardly in surrounding relationship to said upper end portion thereby defining an annular gap therewith so as to cause said sealing means to be separated from said annular body by said gap, said annular body extending upwardly beyond said upper end portion and then projecting inwardly to define flange means overlapping and spaced from said sealing means for absorbing inadvertent external blows acting upon said container; and, attachment means for rigidly attaching said annular body to the outer surface of said wall beneath said upper end portion for transmitting said external blows from said annular body directly to said wall at a location thereon beneath said sealing means whereby said blows bypass said sealing means so as to protect said sealing means therefrom.

2. The container of claim 1, said sealing means being a weld seam; and, said annular body being a ring-shaped body having a substantially L-shaped cross-section, one leg of said body being attached to said outer surface of said vessel and the other leg of said body being a flange defining said flange means and overlapping said weld seam in spaced relationship thereto.

3. The container of claim 2, said ring-shaped body being attached to said vessel at a location beneath said weld seam and said upper end portion of said vessel so as to cause said one leg and said other leg to be in spaced relationship to both said upper end portion and said weld seam.

4. The container of claim 3, said flange of said annular body extending inwardly so as to also overlap a portion of said closing cover.

5. The container of claim 3, comprising projection means on said flange for improving the absorption of external blows inadvertently applied to said container at said annular body.

6. The container of claim 3, comprising guide means formed in said ring-shaped body and adapted for receiving transport hooks therein.

7. The container of claim 6, said guide means including two narrow slots formed in said flange of said ring-shaped body; and, two U-shaped guides mounted to the lower face of said flange at respective ones of said slots so as to straddle the latter.

8. A container for storing radioactive material, the container comprising:

a multilayered vessel having a base and a wall extending upwardly from said base, said wall terminating in an upper end portion defining the opening of the vessel through which the radioactive material to be stored therein is passed;

a closing cover mounted on said upper end portion for closing off said opening and said vessel from the ambient;

a weld seam at the outer periphery of said cover for sealing the same with respect to said vessel;

an L-shaped annular body having one leg mounted to said outer layer of said multi-layered vessel at a location beneath said upper end portion and projecting upwardly in surrounding relationship to said end portion thereby defining an annular gap therewith so as to cause said weld seam to be separated from said annular body by said gap, said annular body extending upwardly beyond said upper end portion whereat the other leg of said L-shaped annular body extends inwardly to define a flange overlapping and spaced from said weld seam for absorbing inadvertent external blows acting upon said container; and, attaching means formed at the interface of said one leg and said outer layer for rigidly attaching said annular body to the outer layer of said wall beneath said upper end portion for transmitting said external blows from said annular body directly to said wall at a location thereon beneath said weld seam whereby said blows bypass said weld seam so as to protect the same therefrom.

9. The container of claim 8, said attaching means being thread means at the interface of said one leg and the outer layer of said wall.

10. The container of claim 8, comprising guide means formed in said other leg for receiving transport hooks therein.

* * * * *